US009808401B2

(12) United States Patent
Ishiwata et al.

(10) Patent No.: US 9,808,401 B2
(45) Date of Patent: Nov. 7, 2017

(54) EXPOSURE-PREVENTING CAP

(71) Applicants: KINKI UNIVERSITY, Higashiosaka-shi, Osaka (JP); GTO, LTD., Osaka-shi, Osaka (JP); NIPRO CORPORATION, Osaka-shi, Osaka (JP)

(72) Inventors: Shunji Ishiwata, Higashiosaka (JP); Atsushi Taga, Higashiosaka (JP); Shozo Nishida, Higashiosaka (JP); Ayako Kita, Higashiosaka (JP); Reiko Sugiura, Higashiosaka (JP); Hideki Fujita, Osaka (JP); Mitsuru Hasegawa, Osaka (JP)

(73) Assignees: KINKI UNIVERSITY, Osaka (JP); GTO, LTD., Osaka (JP); NIPRO CORPORATION, Osaka (JP)

( * ) Notice: Subject to any disclaimer, the term of this patent is extended or adjusted under 35 U.S.C. 154(b) by 361 days.

(21) Appl. No.: 14/403,362

(22) PCT Filed: May 15, 2013

(86) PCT No.: PCT/JP2013/003098
§ 371 (c)(1),
(2) Date: Nov. 24, 2014

(87) PCT Pub. No.: WO2013/179596
PCT Pub. Date: Dec. 5, 2013

(65) Prior Publication Data

US 2015/0112296 A1 Apr. 23, 2015

(30) Foreign Application Priority Data

May 31, 2012 (JP) ..... 2012-124149

(51) Int. Cl.
*A61J 1/14* (2006.01)
*B65D 51/00* (2006.01)
*A61J 1/20* (2006.01)

(52) U.S. Cl.
CPC ..... *A61J 1/1443* (2013.01); *A61J 1/1406* (2013.01); *A61J 1/1425* (2015.05); *B65D 51/002* (2013.01);
(Continued)

(58) Field of Classification Search
CPC ..... A61J 1/1443; A61J 1/1425; A61J 1/1406; A61J 1/2096; A61J 1/145
See application file for complete search history.

(56) References Cited

U.S. PATENT DOCUMENTS 3,429,314 A * 2/1969 Ericson ..... A61F 5/441 55/417
4,582,207 A 4/1986 Howard et al.
(Continued)

FOREIGN PATENT DOCUMENTS

EP 0161797 A2 11/1985
EP 0311787 A2 4/1989
(Continued)

OTHER PUBLICATIONS

Dec. 2, 2014 International Preliminary Report on Patentability issued in International Application No. PCT/JP2013/003098.
(Continued)

*Primary Examiner* — Leslie Deak
(74) *Attorney, Agent, or Firm* — Oliff PLC

(57) ABSTRACT

Provided is an exposure-preventing cap of a novel and simple structure that, by being mounted on a vial, can more reliably inhibit leaking of drug solution to an outside when pulling out and collecting drug solution in a syringe from the vial. An exposure-preventing cap, which is mounted on a mouth of a vial sealed with a rubber stopper, wherein a puncturing hole is formed in a center part of a cap-shaped
(Continued)

housing that is attached to a mouth of the vial, and a rubber membrane is arranged at the puncturing hole so as to form an internal space between facing surfaces of the rubber membrane and the rubber stopper. The rubber membrane has a dome shape that is convex facing the rubber stopper.

6 Claims, 6 Drawing Sheets

(52) U.S. Cl.
CPC ..... *A61J 1/145* (2015.05); *A61J 1/1456* (2015.05); *A61J 1/1468* (2015.05); *A61J 1/2096* (2013.01)

(56) References Cited

U.S. PATENT DOCUMENTS 4,619,651 A * 10/1986 Kopfer ..... A61J 1/2096 604/414
6,280,430 B1 * 8/2001 Neftel ..... A61J 1/2096 604/411

FOREIGN PATENT DOCUMENTS

| | | |
|---|---|---|
| JP | A-61-502170 | 10/1986 |
| JP | A-3-500608 | 2/1991 |
| JP | B2-5-88142 | 12/1993 |
| JP | A-10-508525 | 8/1998 |
| JP | A-11-19177 | 1/1999 |

OTHER PUBLICATIONS

International Search Report issued in International Patent Application No. PCT/JP2013/003098 dated Aug. 20, 2013.
Dec. 14, 2015 Extended Search Report issued in European Patent Application No. 13797404.4.
Dec. 2, 2016 Office Action issued in Japanese Patent Application No. 2014-518258.

* cited by examiner

EXPOSURE-PREVENTING CAP

TECHNICAL FIELD

The present invention relates to an exposure-preventing cap that is mounted on a vial, and that prevents leaking of drug solution to the outside or the like when collecting the drug solution from the vial using a syringe.

BACKGROUND ART

From the past, as medicines that are difficult to store in a drug solution state, items are known that are kept sealed in a vial in a powder or dry state and prepared by dissolving immediately before use.

However, when preparing this kind of drug solution, first, a vial in which the medicine is housed and a syringe in which a solution is filled are prepared, and the needle of the syringe is pierced through the rubber stopper that seals the mouth of the vial. Then, after the medicine for which the solution has been injected into the vial from the syringe is prepared by dissolving inside the vial, the obtained drug solution is collected by suction with the syringe.

Then, the syringe that collected the drug solution is separated from the vial by pulling away the injection needle from the rubber stopper, and this is used for a mixed injection or the like of a drug solution to a transfusion container or line.

However, when pulling the injection needle out from the rubber stopper, there is the risk that drug solution inside the vial or the drug solution that was adhered to the injection needle or the like will go out to the external space in a spilled, splashed, or aerosol state. In particular, medicines kept sealed in a vial are sometimes items with high toxicity such as antitumor drugs or the like, and if that kind of drug solution leaks to the external space or the like, there is a problem of an adverse effect on the bodies of the medical staff, patients, or the like.

In Japanese Patent Republication No. JP-B-5-088142 (Patent Document 1), proposed is confining the drug solution that leaks in the sealed space inside the over cap when pulling out the injection needle from the rubber stopper of the vial by covering the mouth of the vial with an over cap made of rubber and mounting it. However, even when this kind of over cap is mounted, drug solution adheres to the injection needle pulled out from the over cap, and it is difficult to prevent it from leaking to outside the over cap or the like, and it was not possible to obtain a satisfactory effect.

BACKGROUND ART DOCUMENT

Patent Document

Patent Document 1: JP-B-5-088142

SUMMARY OF THE INVENTION

Problem the Invention Attempts to Solve

The present invention was created with the circumstances described above as the background, and the problem it is to solve is to provide an exposure prevention cap of a novel and simple structure that, by being mounted on the vial, can more reliably inhibit leaking of drug solution to the outside when pulling out and collecting drug solution in the syringe from the vial.

Means for Solving the Problem

One aspect of the present invention provides an exposure-preventing cap configured to mount on a mouth of a vial sealed with a rubber stopper, characterized in that: a cap-shaped housing configured to attach to the mouth of the vial has a puncturing hole formed in a center part thereof; at least one rubber membrane is arranged at the puncturing hole so as to form an internal space between facing surfaces of the rubber membrane and the rubber stopper; and the rubber membrane has a dome shape that is convex facing the rubber stopper.

With the exposure-preventing cap of the present invention, when pulling out the injection needle from the vial, the tip of the injection needle being pulled out from the rubber stopper goes via the internal space and is then pulled out from the rubber membrane. At that time, since the rubber membrane has a convex dome shape facing opposite the pulling out direction, by the injection needle pull out force being applied facing the roughly curve center of the rubber membrane, compression stress occurs in the circumferential direction at the rubber membrane. As a result, the rubber membrane is pressed against the outer circumferential surface and tip surface of the pulled out injection needle, and the rubber membrane is rubbed firmly by the surface of the injection needle, so the drug solution adhered to the surface of the injection needle is wiped off.

In fact, the drug solution wiped from the surface of the injection needle is confined to and housed in the internal space, so leaking to the outside is effectively prevented, and it is possible to avoid adverse effects on the body of the medical staff, patients or the like even in the case of highly toxic drug solutions.

Meanwhile, with the exposure-preventing cap according to the present invention, it is preferable that the at least one rubber membrane comprise a plurality of rubber membranes overlapping in a thickness direction.

In this way, by providing a plurality of rubber membranes, the wiping effect by the rubber membranes on the injection needle is additively exhibited by each rubber membrane. In particular, since elastic deformation of each rubber membrane is allowed roughly independently to each other, due to the edge effect and the like of the surface of each rubber membrane, the wiping effect on the injection needle is even more effectively exhibited than with a single thick-walled rubber membrane.

Also, with the exposure-preventing cap according to the present invention, it is preferable that the internal space be in communication with an external space via a filter member.

By having the internal space be in communication with the external space, for example the risk of it being easy for the drug solution to leak because the internal space is in a positive pressure state is avoided. In fact, since the filter member is arranged in the communication path between the internal space and the external space, it is also possible to effectively prevent leaking of the drug solution through that communication path.

As the filter member arranged in the communication path, it is possible to use any of the items including filter paper, nonwoven fabric, a membrane or the like, but a filter member constituted of interconnected cell foam is especially preferable. With this kind of foam, since communication holes of complex paths extending non-linearly within the filter member are formed, it is possible to ensure a large absorption holding volume of the drug solution, and also possible to more effectively suppress leaking of the drug solution to the external space in a spilling, splashing, aerosol state or the like.

Furthermore, when providing the previously described communication path, there is no limit on the specific position, number, shape, size or the like, but the following constitution can be used, for example. Specifically, an aspect wherein the housing is configured to overlap the vial with the filter member being sandwiched therebetween at an outer circumference part of the mouth of the vial, and the internal space is in communication with the external space through a space between overlapping surfaces of the housing and the vial, can be optimally used when providing the communication path with the present invention.

With the communication path with this kind of structure, it is possible to form the communication path between the housing and the vial, and the housing structure is simple, without needing to form the communication path in the housing itself. Also, in the periphery of the internal space, it is also possible to ensure a large space for forming the communication path. Furthermore, by sandwiching the filter member between the housing and the vial, it is possible to reliably prevent the occurrence of a gap in the periphery of the filter member or the like.

With this mode, it is preferable that a communication path in which a filter member is arranged be formed so as to enclose the periphery of the internal space along the entire periphery. By doing this, while keeping the gap between the housing and the vial small and being able to securely attach the housing to the vial, it is possible to ensure a large effective through path cross section area for the entire communication path.

Also, when forming the communication path along the entire periphery of the periphery of the internal space, as the filter member arranged in the communication path, it is preferable to use an item with an annular disk shape, and to have the center part punctured by the injection needle at the rubber stopper of the vial covered by the filter member. By doing this, it is possible to prevent coring of the filter member that occurs with puncturing, without having the injection needle puncture the filter member.

Furthermore, with the exposure-preventing cap according to the present invention, it would also be possible that at an external opening part of the puncturing hole of the housing, an inclined plane for guiding a puncture needle toward the puncturing hole is partially formed in a circumferential direction.

With this kind of inclined plane, it is possible to lead the injection needle to the puncture position, and to improve the safety and ease of puncture work. Also, through the area in which the inclined plane is not formed on the circumference, it is easy to see the injection needle, so it is possible to further improve the safety of puncture work by visual confirmation.

Effect of the Invention

With the exposure-preventing cap constituted according to the present invention, when pulling out the injection needle from the vial, making good use of the elastic stress generated on the dome shaped rubber membrane, it is possible to wipe the drug solution adhered to the surface of the injection needle, and also possible to confine and house the wiped drug solution in the internal space. Therefore, it is possible to effectively prevent leaking of the drug solution to the outside when pulling out the injection needle from the vial.

EMBODIMENTS FOR CARRYING OUT THE INVENTION

Figure 1:
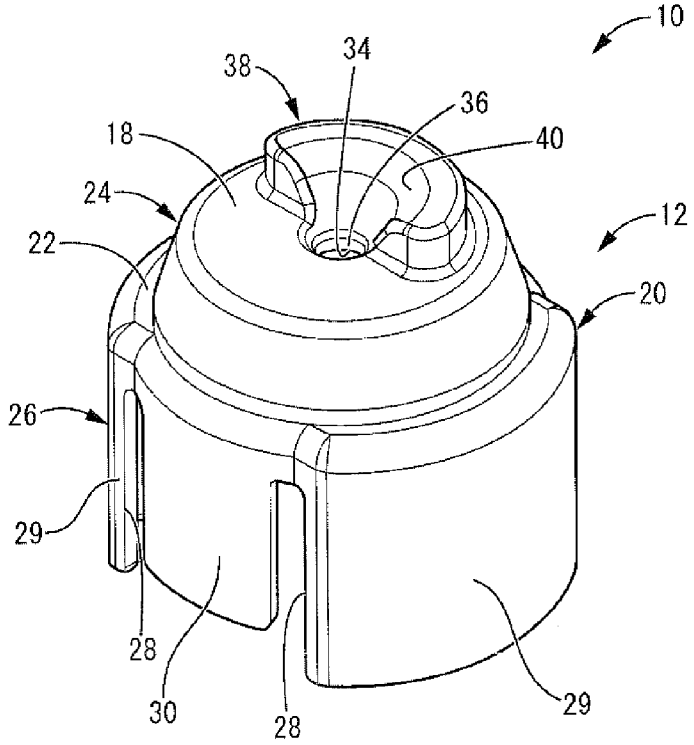
FIG. 1 is a perspective view showing an exposure-preventing cap as an embodiment of the present invention.
Figure 2:
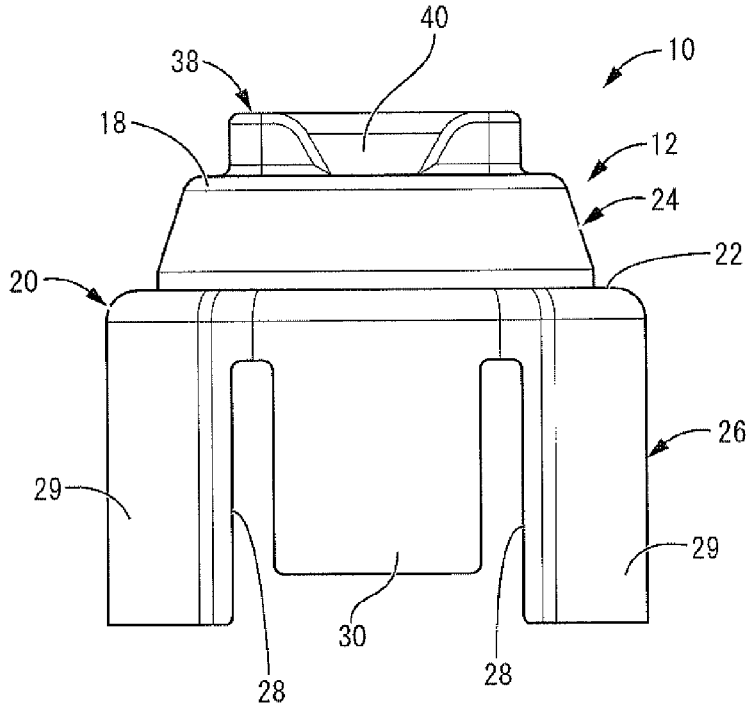
FIG. 2 is a front view of the exposure-preventing cap shown in FIG. 1.
Figure 3:
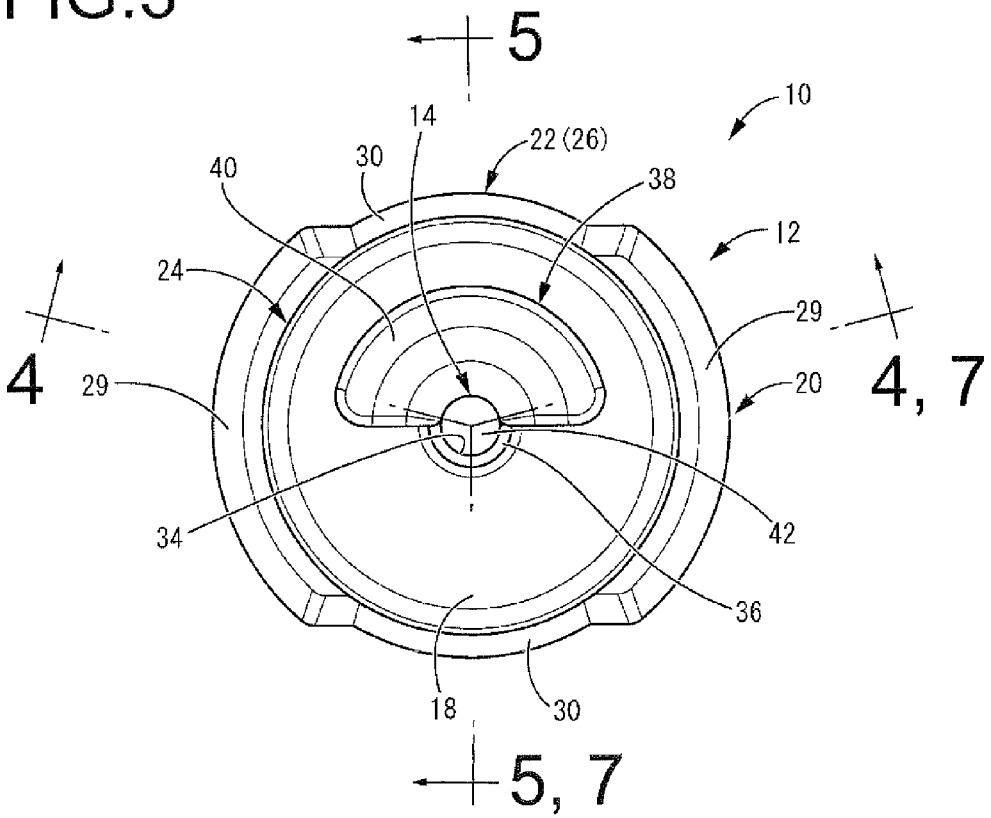
FIG. 3 is a plan view of the exposure-preventing cap shown in FIG. 1.
Figure 4:
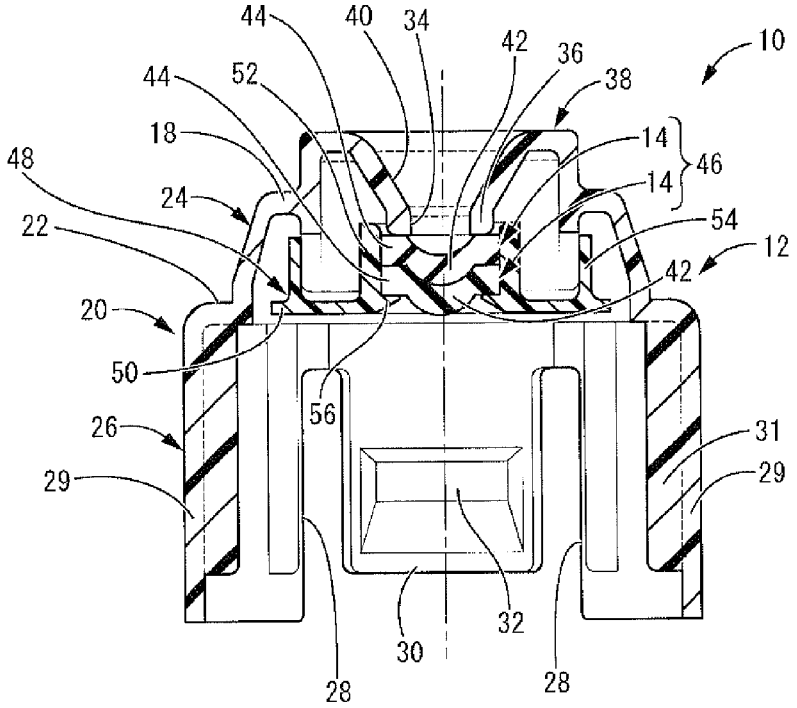
FIG. 4 is a cross-section view taken along line 4-4 of FIG. 3.
Figure 5:
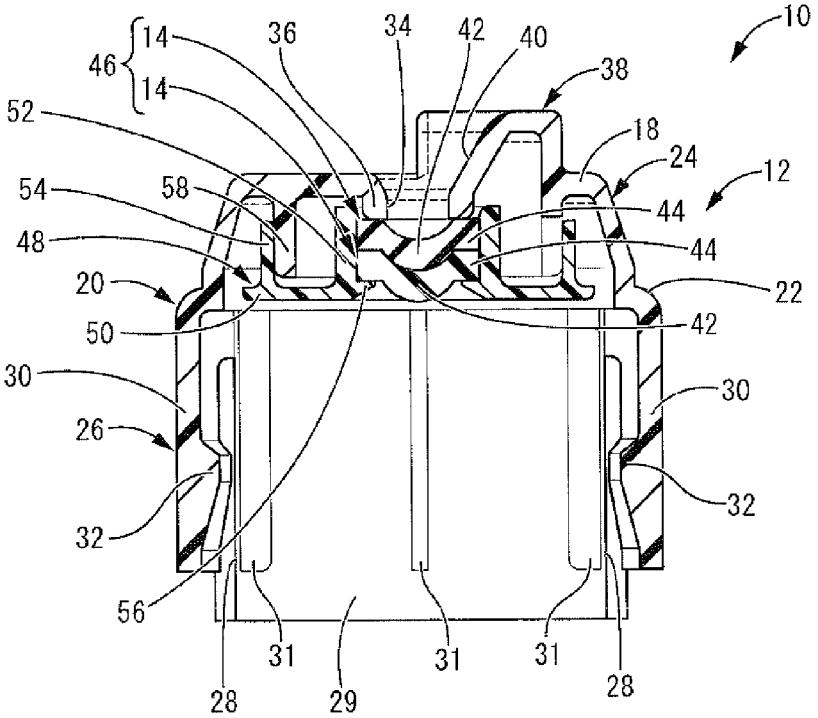
FIG. 5 is a cross-section view taken along line 5-5 of FIG. 3.
Figure 6:
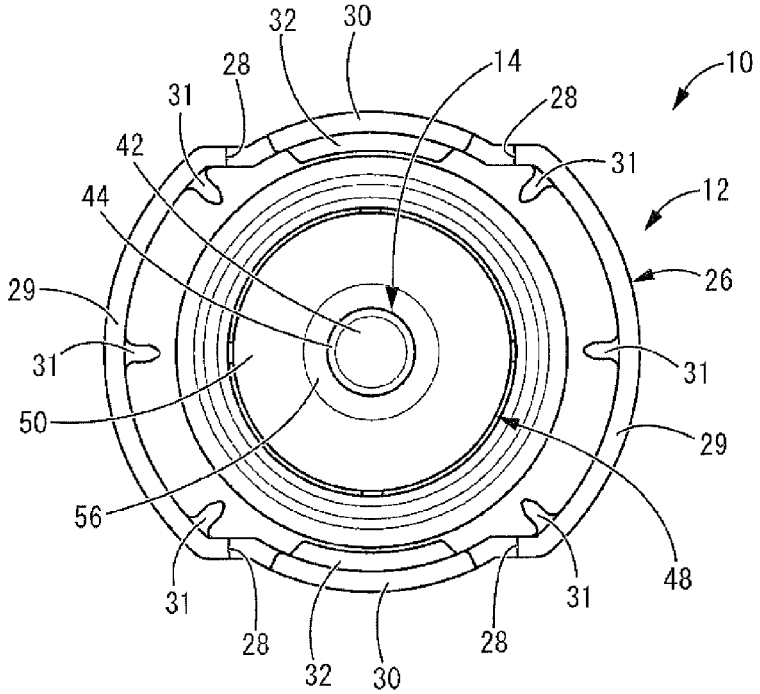
FIG. 6 is a bottom view of the exposure-preventing cap shown in FIG. 1.
Figure 7:
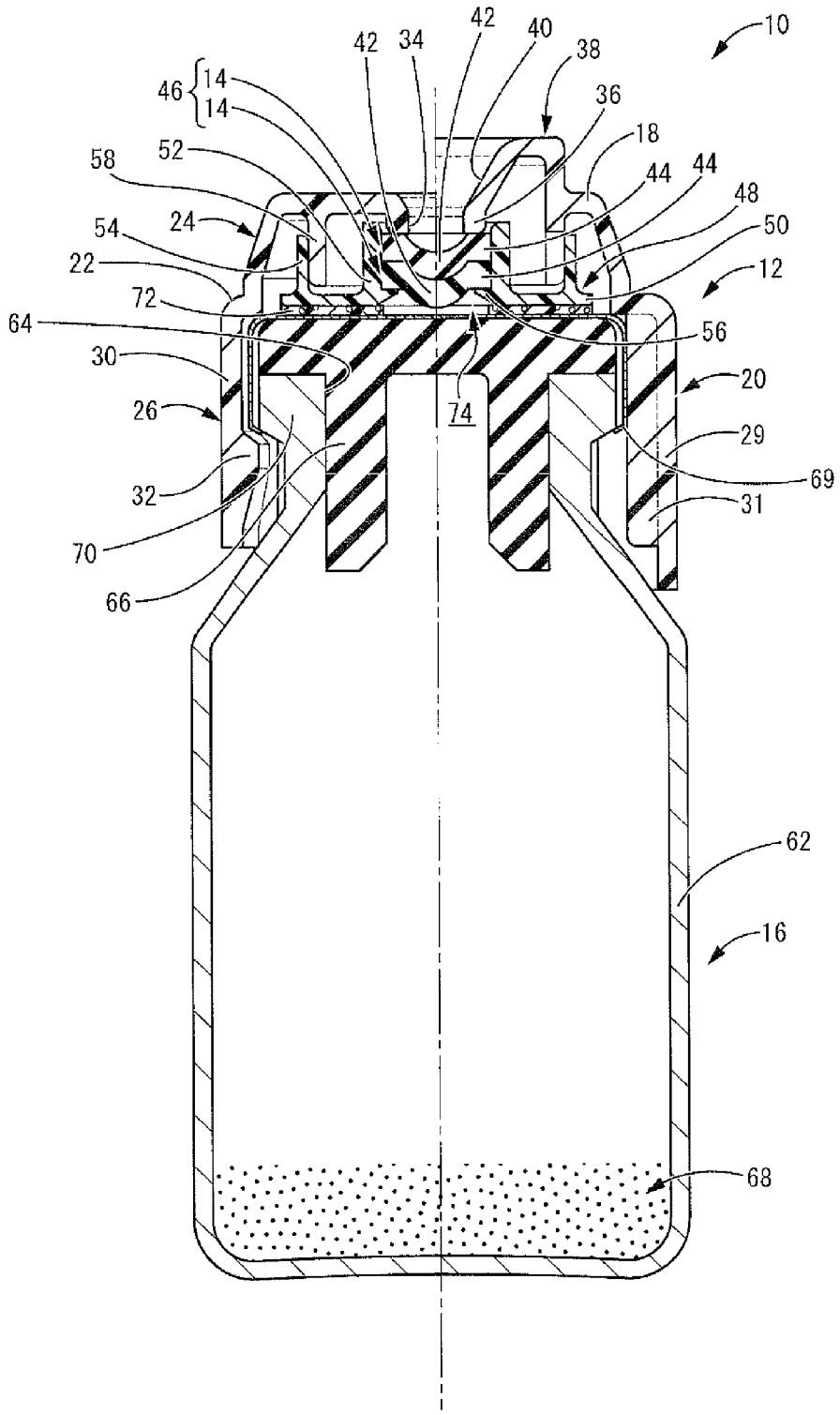
FIG. 7 is a vertical cross-section view correlating to cross section taken along line 7-7 of FIG. 3, showing the mounted state of the exposure-preventing cap shown in FIG. 1 on a vial.

Following, we will describe an embodiment of the present invention while referring to the drawings. First, in FIG. 1 through FIG. 6, an exposure-preventing cap 10 is shown as an embodiment of the present invention. This exposure-preventing cap 10 has a constitution with which valve type rubber membranes 14, 14 are attached to a housing 12, and as shown in FIG. 7, this is used mounted in cap form to cover a mouth 64 (described later) for a vial 16.

In more detail, the housing 12 overall has a round, roughly inverted cup shape that opens facing downward, and a roughly round tube shaped circumferential wall part 20 extending facing downward from the outer circumferential edge part of a round disk shaped upper base part 18 is integrally formed therewith. A step part 22 is provided in the middle part of the height direction on the circumferential wall part 20, and provided sandwiching the step part 22 are a top side circumferential wall part 24 and a bottom side circumferential wall part 26. This kind of housing 12 is constituted from a known synthetic resin material such as polypropylene, polyethylene, ABS (acrylonitrile butadiene styrene) resin or the like.

The top side circumferential wall part 24 has a tapered tube shape with a decreasing diameter facing upward. On the other hand, the bottom side circumferential wall part 26 extends facing downward with a round tube shape, and at four locations on the circumference, slits 28 extending facing upward from the lower edge are provided, and the bottom side circumferential wall part 26 is divided into four parts in the circumferential direction. By doing this, on the bottom side circumferential wall part 26, a pair of cover pieces 29, 29 and a pair of locking pieces 30, 30 are formed positioned facing opposite respectively in the radial direction.

Also, on the pair of cover pieces 29, 29, respective reinforcing ribs 31 are integrally formed so as to extend vertically on the inner circumference surface thereof. On the other hand, on the pair of locking pieces 30, 30, respective locking projections 32 are integrally formed so as to project facing the inner surface at the lower edge part thereof.

Furthermore, on the upper base part 18 of the housing 12, a puncturing hole 34 is formed extending piercing through the center part along the center axis. At the opening circumferential edge part of the puncturing hole 34 on the upper base part 18 is formed an annular projection 36 projecting facing downward.

Also, a guiding projection 38 is integrally formed on the radially middle part of the upper base part 18 and projects upward. This guiding projection 38 is formed at a circumferential direction length that does not complete one circumference on the external opening part of the puncturing hole 34, and with this embodiment, is a circumferential direction length of roughly half the circumference. Specifically, the guiding projection 38 is a semicircular plateau shape, and its semicircular inner circumferential surface is a funnel shaped inclined plane 40 extending downward with a gradually smaller diameter facing the puncturing hole 34. Using this inclined plane 40, it is possible to easily guide an injection needle 80 which serves as a puncture needle described later to the puncturing hole 34.

In addition, rubber membranes 14, 14 are housed and arranged and attached beneath the upper base part 18, in an area enclosed by the top side circumferential wall part 24 inside the housing 12. The rubber membranes 14 have an overall circular plate shape, with the center part being a valve part 42 that bulges downward in a convex dome shape facing downward. Also, the outer circumference part of the rubber membrane 14 is an annular disk shaped support part 44 that broadens radially outward from the outer circumferential edge part of the valve part 42. This kind of rubber membrane 14 is constituted by a known rubber material such as natural rubber, synthetic elastomer or the like.

Particularly with this embodiment, two rubber membranes 14, 14 of the same shape and the same material are overlapped with each other in the plate thickness direction, and a double structure valve body is constituted by assembling these in a non-adhered state. The valve part 42 of the rubber membrane 14 has the top side concave surface and the lower side convex surface as a spherical crown, and by having the radius of curvature of the concave surface and the radius of curvature of the convex surface be equal and having the outer diameter dimensions also be equal, the convex surface of the valve part 42 of the top side rubber membrane 14 is made to overlap roughly tightly adhered on the concave surface of the valve part 42 of the lower side rubber membrane 14.

Then, a valve body 46 constructed of an overlapped structure of these two rubber membranes 14, 14 is attached to the housing 12 in a state held by a retaining member 48. The retaining member 48 is equipped with an annular disk shaped base part 50, and integrally includes a round tube shaped retaining tube part 52 projecting upward from the inner circumference part of the base part 50 and a round tube shaped fixing tube part 54 projecting upward from the outer circumference part of the base part 50.

Also, at the bottom edge part of the retaining tube part 52, a ring shaped support projection 56 projecting to the inner circumference surface is formed. Then, the rubber membranes 14, 14 fit into and housed in the retaining tube part 52 are housed inside retaining tube part 52 by the outer circumference part of the support parts 44, 44 being overlapped on the support projection 56.

On the other hand, the fixing tube part 54 of the retaining member 48 is fit to an annular fixing rib 58 provided projecting downward from the upper base part 18 of the housing 12, and by being fixed as necessary by adhesion, welding or the like, the retaining member 48 is attached to an area surrounded by the top side circumferential wall part 24 inside the housing 12. By the housing 12 and the retaining member 48 being formed using for example a thermoplastic synthetic resin material, it is possible to more easily fix by adhesion and welding.

Then, in a state with the retaining member 48 fixed to the housing 12, the rubber membranes 14, 14 housed in the retaining tube part 52 are sandwiched and squeezed between the support projection 56 of the retaining member 48 and the annular projection 36 of the housing 12 in the direction in which the support parts 44, 44 overlap. By doing this, the valve body 46 attached with the two rubber membranes 14, 14 in a sealed state is arranged beneath the puncturing hole 34 of the housing 12, and the opening toward below the puncturing hole 34 is sealed fluid tight by the valve body 46.

The exposure-preventing cap 10 of this embodiment with this kind of constitution is used mounted on the vial 16 as shown in FIG. 7. The vial 16 is a known item, and the mouth 64 of a bottle body 62 formed using glass or the like has a tightly sealed structure sealed by a rubber stopper 66, and a medicine 68 is housed in the interior. With the rubber stopper 66, a metal seal member 69 that covers the outer circumference surface is crimped and adhered to a flange part 70 formed on the mouth 64 of the bottle body 62, ensuring a tightly sealed structure for the vial 16.

Also, when mounting on the vial 16, a filter member 72 is attached to the exposure-preventing cap 10. This filter member 72 has tiny interconnected cells, and for example can have a constitution with a foam elastic body formed using an elastomer or the like. In particular with this embodiment, it has an annular disk shape, is overlapped on the bottom surface of the base part 50 of the retaining member 48, and is mounted by being aligned using adhesion as necessary. Then, in a state with the exposure-preventing cap 10 mounted on the vial 16, the filter member 72 is interposed in a compressed state sandwiched between the facing surfaces of the base part 50 of the retaining member 48 and the rubber stopper 66 of the vial 16. In other words, at the outer circumference part of the mouth 64 of the vial 16, the housing 12 overlaps the vial 16 with the filter member 72 being sandwiched therebetween.

Thus, by covering the exposure-preventing cap 10 on the mouth 64 of the vial 16 from above and pressing down, the locking projections 32, 32 of the pair of locking pieces 30, 30 at the bottom side circumferential wall part 26 of the housing 12 can be locked to the flange part 70 of the mouth 64 of the vial 16. By doing this, it is possible to mount the housing 12, specifically the exposure-preventing cap 10, so as to cover the mouth 64 of the vial 16 in a capped state. Also, the rubber membrane 14 of the exposure-preventing cap 10 is arranged in a dome shape that is convex facing the rubber stopper 66 of the vial 16.

In this mounted state, by abutting the step part 22 of the exposure-preventing cap 10 on the outer circumferential edge part of the metal seal member 69 that covers the rubber stopper 66 of the vial 16, rattling of the exposure-preventing cap 10 on the vial 16 is prevented.

In this kind of state with the exposure-preventing cap 10 mounted on the vial 16, the center part of the rubber stopper 66 of the vial 16 and the center part of the valve body 46 of the exposure-preventing cap 10 are arranged facing opposite separated by a designated distance. Then, between the facing surfaces of the rubber stopper 66 and the valve body 46, an internal space 74 of a designated capacity is formed, and this internal space 74 is in communication with the external space via the filter member 72. With this embodiment, the internal space 74 is in communication with the external space through the space between the outer circumference surface of the metal seal member 69 covering the mouth 64 of the vial 16 and the bottom side circumferential wall part 26 of the housing 12.

Figure 8:
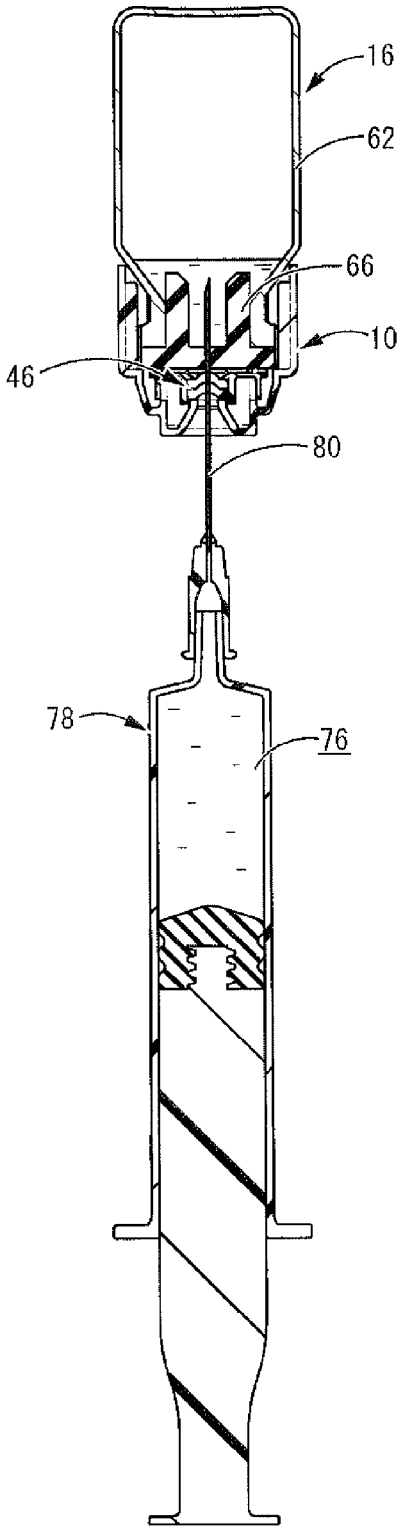
FIG. 8 is a vertical cross-section view showing the state with a needle of a syringe punctured in the vial with the exposure-preventing cap shown in FIG. 7 mounted.

Also, when using the vial 16 on which the exposure-preventing cap 10 is mounted as described here, as is well known, a solvent liquid is injected into the vial 16 using a syringe to prepare the drug solution, and this drug solution is again suctioned using the syringe and collected. After that, as shown in FIG. 8, for example, a syringe 78 in which a drug solution 76 prepared inside the vial 16 is suctioned and collected is inverted vertically from the state shown in FIG. 8, and the injection needle 80 is pulled out from the rubber stopper 66 and separated from the vial 16, and the drug solution 76 is used for a mixed injection or the like in a transfusion container or line.

Figure 9A:
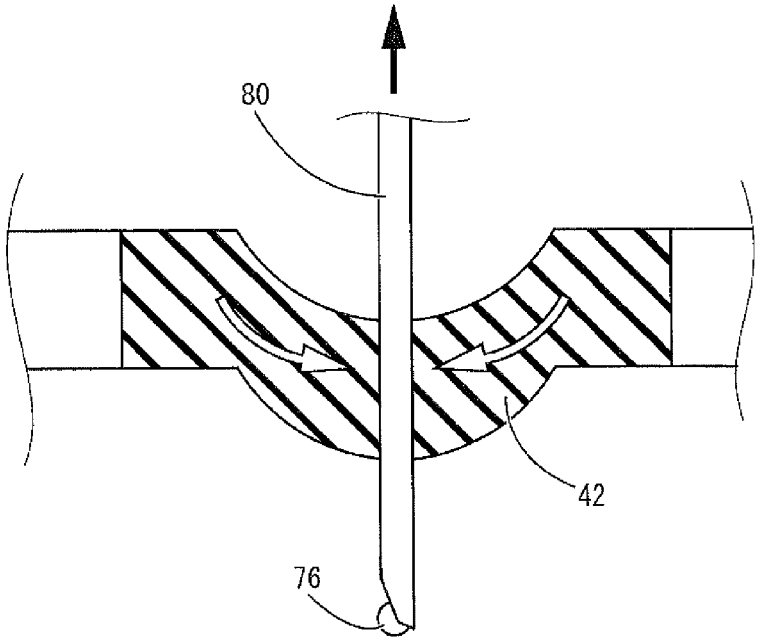
FIG. 9A is a specific view for describing the generated stress of a rubber membrane when the injection needle is pulled out with the exposure-preventing cap of the present invention.

Here, leaking of the drug solution when the injection needle 80 which has pierced and punctured inside the vial 16 is pulled out from the rubber stopper 66 of the vial 16 is more effectively prevented by the exposure-preventing cap 10 of this embodiment. Specifically, with the exposure-preventing cap 10 of this embodiment, the valve part 42 of each rubber membrane 14 constituting the valve body 46 has a spherical crown shape that is convex downward as shown in FIG. 9A. Therefore, when the injection needle 80 punctured in this valve part 42 is pulled out upward, due to the friction force with the injection needle 80 on the valve part 42, the projection height downward becomes smaller and elastic deformation occurs in the shrinking direction (in FIG. 9A, the direction shown by the white arrow). As a result, the valve part 42 is pressed against roughly the entire surface of the puncture part to the valve part 42 of the injection needle 80, and the injection needle 80 is pulled out upward while drawn by the valve part 42. Therefore, while the injection needle 80 is removed so that the liquid or the like adhered to the surface is forcefully wiped off not only for the outer circumference surface but also for the tip part, it is pulled out to the external space, and it is possible to effectively prevent leaking of the drug solution 76 to the external space.

Figure 9B:
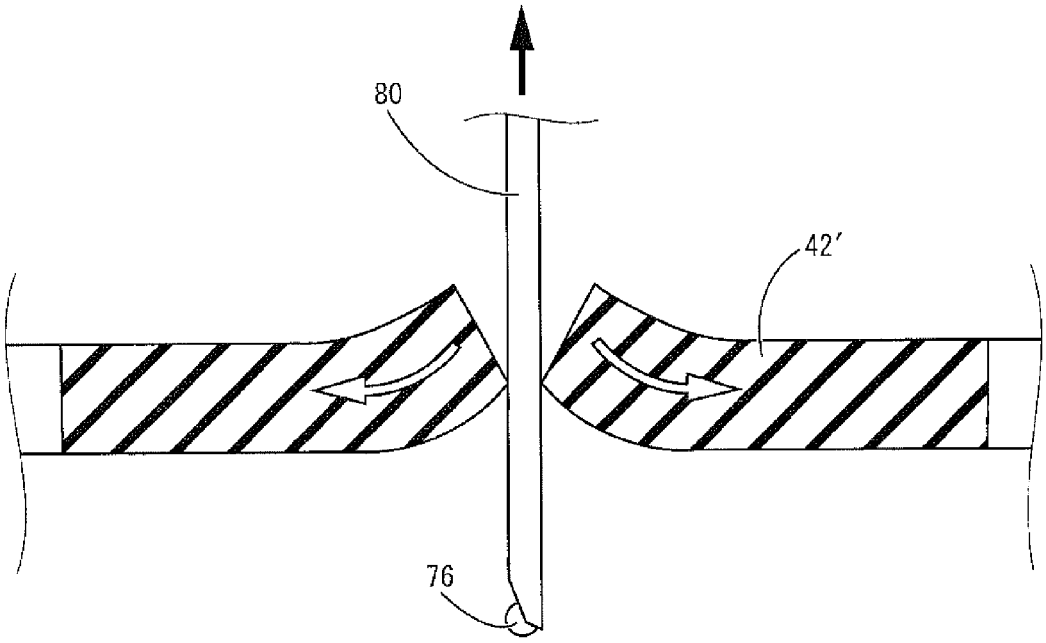
FIG. 9B is a specific view for describing the generated stress when the injection needle is pulled out with a plane shaped rubber membrane as a Comparative Example.

The wiping effect of the drug solution 76 in relation to the injection needle 80 by the valve part 42 can be easily understood by comparing with the valve part 42' constructed of a plane shaped rubber membrane as a Comparative Example shown in FIG. 9B, for example. Specifically, with the plane shaped valve part 42', when pulling out the punctured injection needle 80, due to the friction force with the injection needle 80 on the valve part 42', elastic deformation occurs in the direction extending upward. Therefore, the pressing force of the valve part 42' on the injection needle 80 becomes smaller, and conversely, elastic deformation occurs in the direction separating from the injection needle 80 (in FIG. 9B, the direction shown by the white arrow), so it is easy for a gap to occur between the outer circumference surface and the tip part of the injection needle 80, and it is hard to expect an effective leak preventing effect for the drug solution.

In fact, with this embodiment, the drug solution 76 wiped by the valve part 42 of the rubber membrane 14 is housed in the internal space 74, and diffusion to the external space is prevented. Therefore, by disposing of the vial 16 with the exposure-preventing cap 10 still mounted, it is possible to almost completely prevent exposure for health care providers.

In particular with this embodiment, the internal space 74 is in communication with the external space via the filter member 72 that is able to capture the drug solution 76, so even when the pressure inside the vial 16 changes along with operation of the syringe 78 or the like, it is possible to keep the internal space 74 at atmospheric pressure. Therefore, when pulling out the injection needle 80, when the tip of the injection needle 80 passes through the internal space 74, the interior of the syringe 78 returns to atmospheric pressure, and it is possible to effectively prevent leaking of the drug solution 76 due to a change in pressure between the inside and outside of the syringe 78 after pulling out from the valve part 42.

Furthermore, with this embodiment, since the valve part 42 is constituted with two rubber membranes 14, 14 that can be independently deformed, the wiping effect of the drug solution 76 in relation to the injection needle 80 as described above is exhibited with each respective rubber membrane 14, 14, and it is possible to have the drug solution leak prevention effect exhibited at an even higher level.

Above, we gave a detailed description of this embodiment of the present invention, but the present invention is not to be interpreted as being limited by the specific notations of this embodiment. For example, the rubber membrane 14 can also have a dome shape that is convex facing the rubber stopper 66, and can generate compression stress when pulling out the injection needle 80, and the wall thickness dimension, size (diameter dimension), curvature or the like of the valve part 42 are not limited, and can be suitably set according to the used size of the mouth 64 of the vial 16, the size of the injection needle 80 or the like.

Also, the dome shape of the rubber membrane 14 does not have to have a fixed radius of curvature in its entirety, and for example can also have gradual changes in the radius of curvature facing from the center part toward the outer circumference part.

Yet further, with the embodiment noted above, the radius of curvature of both surfaces on the valve part 42 of the rubber membrane 14 was roughly the same so as to have the two rubber membranes 14, 14 overlap in a roughly tightly adhered state, but it is not necessary that both surfaces of the valve part 42 have the same shape, and for example it is possible to have the radius of curvature of the convex surface be larger than that of the concave surface of the valve part 42, and to have the valve part 42 thickness dimension be roughly fixed for the entirety or the like.

Furthermore, with the embodiment noted above, the two rubber membranes 14, 14 were used overlapped in a tightly adhered state, but it is also possible to have a gap between the overlapping surfaces, and possible to use one rubber membrane 14 or three or more rubber membranes 14.

Also, the communication structure of the internal space 74 to the external space via the filter member 72 is not absolutely essential with the present invention, and it is also possible to have a tightly sealed structure for the internal space 74 between the facing surfaces of the rubber stopper 66 and the valve body 46. In that case as well, the wiping effect of the drug solution 76 in relation to the injection needle 80 by the rubber membrane 14 as described above can be effectively exhibited.

Yet further, the funnel shaped inclined plane 40 using the guiding projection 38 is effective in further improving the safety when removing the drug solution 76, but it is not absolutely essential with the present invention. It is also not necessary to provide this inclined plane 40, and it is also possible to provide an inclined plane for guiding in a mode that extends along the entire circumference of the periphery of the puncturing hole 34.

EXAMPLES

Incidentally, to confirm the effect of the present invention, the effect confirmation tests described hereafter were performed on Examples of the present invention and on a Comparative Example.

First, as Examples of the present invention, Examples 1 through 5 with differentiated shapes of rubber membrane 14 made of isoprene, which is the exposure-preventing cap 10 of the structure noted above, were prepared. The rubber membrane 14 had a thickness of 1.0 mm for Examples 1 through 4, and a thickness of 1.5 mm for Example 5. The radius of curvature of the concave/convex surface part of the rubber membrane 14 which has a dome shape has the concave surface part and the convex surface part the same for all the Examples, and with Example 1 is 2.0 mm, with Examples 2, 4, and 5 is 3.0 mm, and with Example 3 is 4.0 mm. Furthermore, the depth dimension of the concave surface part is 0.5 mm with Examples 1 to 3, and 1.0 mm with Examples 4 and 5. With Examples 1 through 5, two rubber membranes 14 having the shape as described above were arranged inside the housing 12 overlapping each other in a tightly adhered state.

Next, instead of the dome shaped rubber membrane 14, a Comparative Example 1 of the exposure-preventing cap was prepared using a plane shaped rubber membrane made of isoprene. The plane shaped rubber membrane has a thickness of 1.5 mm, and two rubber membranes were arranged inside the housing 12 overlapped in a tightly adhered state.

As the vial, an item was prepared by filling 6 mL of 50 weight % ethanol in a vial bottle made by Maruemu Corp. (No. 5, 20 mL) and crimping. As the syringe 78 and the injection needle 80, respectively, prepared were a 20 mL Nipro disposable syringe (nominal capacity 25 mL) made by Nipro Corp. and a 18Gx1' ½ RB needle (Flomax) made by Nipro Corp.

As the testing method, first, the injection needle was mounted in the syringe, and put to a state for which the plunger was pushed to the end point. Next, the exposure-preventing cap 10 of the present invention was attached to the vial, and in a state with the puncturing hole 34 facing upward, the injection needle was punctured inside the puncturing hole 34. After leaving for 15 seconds as is, the entirety was inverted vertically, and the needle was withdrawn at a speed of about 30 cm movement per 2 seconds. Then, the dome shaped rubber membrane 14 and the plane shaped rubber membrane surfaces were observed visually, and the presence or absence of droplets adhered to the surface of the rubber membrane was confirmed. Furthermore, when there were droplets, the diameter of the droplets was measured. When droplets were adhered, the number of droplets was 1 in each case. This kind of testing method was performed 10 times each for the Examples and the Comparative Example, and the results are shown in Table 1 hereafter.

TABLE 1

| | | Example 1 | Example 2 | Example 3 | Example 4 | Example 5 | Comparative Example 1 |
|---|---|---|---|---|---|---|---|
| Rubber membrane shape | Shape | | | Dome shape | | | Plane shape |
| | Thickness | 1.0 | 1.0 | 1.0 | 1.0 | 1.5 | 1.5 |
| | Convex surface/ Concave surface curvature radius | 2.0 | 3.0 | 4.0 | 3.0 | 3.0 | — |
| | Concave surface depth | 0.5 | 0.5 | 0.5 | 1.0 | 1.0 | — |
| | Number of overlapping sheets | 2 | 2 | 2 | 2 | 2 | 2 |
| Presence or absence of droplets on the rubber membrane surface after needle withdrawal | 1st time | None | None | None | None | None | None |
| | 2nd time | None | None | None | None | None | About 0.3 mm |
| | 3rd time | None | None | None | None | Less than 0.1 mm | None |
| | 4th time | None | None | Less than 0.1 mm | None | Less than 0.1 mm | None |
| | 5th time | None | None | None | None | Less than 0.1 mm | 0.1 mm or greater |
| | 6th time | Less than 0.1 mm | None | None | None | None | About 0.3 mm |
| | 7th time | None | None | None | None | None | None |
| | 8th time | Less than 0.1 mm | None | None | None | None | About 0.3 mm |
| | 9th time | None | Less than 0.1 mm | None | None | None | About 0.3 mm |
| | 10th time | None | None | None | None | Less than 0.1 mm | About 0.3 mm |

As shown in Table 1 noted above, with Examples 1 through 5, there were almost no cases of observation of droplets adhered to the surface of the rubber membrane 14, and in the adhered cases, the droplet diameter was small at less than 0.1 mm. Therefore, with the exposure-preventing cap of the present invention, by using the dome shaped rubber membrane 14 that is convex facing the rubber stopper of the vial, it is possible to confirm that it is possible to prevent or suppress to a high degree leaking of the drug solution to outside air. Also, with Examples 1 through 4, despite the thickness of the rubber membrane 14 being smaller than that of the Comparative Example 1, it was possible to confirm that it is possible to advantageously prevent adherence of droplets to the surface of the rubber membrane 14.

On the other hand, with the Comparative Example 1, many cases of adherence of droplets on the surface of the plane shaped rubber membrane were observed (6 times out of 10), and when adhered, the diameter of the droplets was 0.1 mm or greater, and almost all were around 0.3 mm. Therefore, with the exposure-preventing cap using the plane shaped rubber membrane, it is possible to confirm that it is difficult to sufficiently prevent leaking of the drug solution to outside air.

KEYS TO SYMBOLS

10: Exposure-preventing cap, 12: Housing, 14: Rubber membrane, 16: Vial, 34: Puncturing hole, 40: Inclined plane, 64: Mouth, 66: Rubber stopper, 72: Filter member, 74: Internal space, 80: Injection needle

The invention claimed is:

1. An exposure-preventing cap configured to mount on a mouth of a vial sealed with a rubber stopper, comprising:

a cap-shaped housing configured to attach to the mouth of the vial and having a puncturing hole formed in a center part thereof; and at least one rubber membrane arranged at the puncturing hole so as to form an internal space between facing surfaces of the rubber membrane and the rubber stopper, the rubber membrane having a dome shape that is convex facing the rubber stopper, wherein a radially center part of the rubber membrane has a top side concave surface and a lower side convex surface as a spherical crown.

2. The exposure-preventing cap according to claim 1, wherein the at least one rubber membrane comprises a plurality of rubber membranes overlapping in a thickness direction.

3. The exposure-preventing cap according to claim 1, wherein the internal space is in communication with an external space via a filter member.

4. The exposure-preventing cap according to claim 3, wherein the filter member is constituted of interconnected cell foam.

5. The exposure-preventing cap according to claim 3, wherein the housing is configured to overlap the vial with the filter member being sandwiched therebetween at an outer circumference part of the mouth of the vial, and the internal space is in communication with the external space through a space between overlapping surfaces of the housing and the vial.

6. The exposure-preventing cap according to claim 1, wherein at an external opening part of the puncturing hole of the housing, an inclined plane for guiding a puncture needle toward the puncturing hole is partially formed in a circumferential direction.

* * * * *